US006435265B1

(12) United States Patent
Lakdawala et al.

(10) Patent No.: US 6,435,265 B1
(45) Date of Patent: Aug. 20, 2002

(54) GRAVITY COOLING UNIT

(76) Inventors: Ness Lakdawala, 119 DE Tourine, St. Lambert, Québec (CA), J2S 1H3; Michel LeCompte, 1024 Rue Leon Ringuet, Boucherville, Québec (CA), J4B 8E9

( * ) Notice: Subject to any disclaimer, the term of this patent is extended or adjusted under 35 U.S.C. 154(b) by 8 days.

(21) Appl. No.: 09/613,449

(22) Filed: Jul. 10, 2000

Related U.S. Application Data

(63) Continuation-in-part of application No. 08/586,157, filed on Jan. 17, 1996.

(30) Foreign Application Priority Data

Jan. 17, 1995 (CA) ..... 2140404

(51) Int. Cl.[7] ..... F24D 5/10; F25D 21/14

(52) U.S. Cl. ..... 165/53; 165/913; 62/290

(58) Field of Search ..... 62/DIG. 16, 413, 62/407, 285, 290, 286; 237/69; 165/53, 913, 128, 129

(56) References Cited

U.S. PATENT DOCUMENTS

| | | | | | |
|---|---|---|---|---|---|
| 2,175,396 | A | * | 10/1939 | Hoffman | 62/290 |
| 2,210,725 | A | * | 8/1940 | MacMaster | 62/286 |
| 2,238,543 | A | * | 4/1941 | Trotter | 62/285 |
| 2,798,366 | A | * | 7/1957 | Erl | 62/285 |
| 2,856,161 | A | * | 10/1958 | Flynn | 165/129 |
| 3,097,507 | A | * | 7/1963 | Makuh | 62/285 |
| 3,212,288 | A | * | 10/1965 | Herbert | 62/290 |
| 4,546,820 | A | * | 10/1985 | Whippe | 62/285 |

* cited by examiner

*Primary Examiner*—Henry Bennett
*Assistant Examiner*—Tho V Duong

(57) ABSTRACT

A gravity cooling unit having at least one pair of cooling columns with each column having a plurality of cooling fins mounted on one more serpentine cooling coils carrying a refrigerant. The unit has mounting means for use in mounting the unit against a ceiling. The pair of cooling columns are fixed to the mounting means to have the long axis of their fins angled toward each other to form a downwardly diverging air space between them, and to have the short, upper side of their fins adjacent the ceiling, when the unit is mounted on the ceiling, to minimize air flow between the columns and the ceiling. A condensate collector is provided under each column wide enough to extend beneath each coil in the column.

19 Claims, 4 Drawing Sheets

GRAVITY COOLING UNIT

RELATED APPLICATIONS

This application is a continuation-in-part application of application Ser. No. 08/586,157, filed Jan. 17, 1996.

BACKGROUND OF THE INVENTION

1. Field of the Invention

This invention is directed toward an improved gravity cooling unit.

2. Description of Related Art Including Information Disclosed Under 37 CFR §§1.97 and 1.98

Gravity cooling units are cooling units used to cool room air without using a fan or a blower. The cooling unit has a plurality of cooling fins mounted on lengths of pipe which pipe lengths are joined together at their ends, past the fins, in one or more serpentine coils. The coils carry refrigerant. The cooling fins form a single, slab-like structure or column that is mounted on the ceiling of the room to be cooled with a wide side of the column facing the ceiling. The column is spaced from the ceiling to form a path providing air flow to the top of the fins. A condensate pan is mounted beneath the column to collect condensate from the column. The condensate pan is spaced below the column to form a path providing air flow from the bottom of the fins. The warm air in the room rises, passes over and down through the fins of the unit to be cooled, and passes out the air path between the pan and the column back into the room. These known units are quite bulky, needing a top clearance from the ceiling for air flow and a bottom clearance for air flow between the condensate pan and the fins. They are also relatively inefficient since the condensate pan prevents the direct return of air to the room, the air instead having to pass around the condensate pan. A cooling unit having a wide column is also relatively inefficient since less air will flow to the middle of the unit. Less air flow can lead to freezing up of the middle of the unit.

To improve the efficiency of these gravity cooling units, it is known to provide a cooling unit with at least two columns arranged so as to provide a vertical air channel between the columns. Such a unit is shown in C.P. U.S. Pat. No. 1,202,957, issued Apr. 8, 1986, Guy St. Pierre, inventor. Each column has the long axis of the fins vertical. To avoid blocking the air channel a separate, generally horizontal, condensate pan is provided under each column. This arrangement provides better air flow and is therefore more efficient than those cooling units which employ a single wide column. However the arrangement still requires a top clearance from the ceiling to allow warm air to flow over the columns and down into the vertical passage. Thus the unit takes up a relatively large amount of vertical space in the room and limits head room. These cooling units are used primarily in cold rooms which are built with low ceilings to begin with and thus the vertical space that the units occupy is critical. The vertical columns are also inefficient since condensate from the top pipe lengths in the columns will drop onto the lower pipe lengths thereby lowering their cooling efficiency. Wide units also still have the problem of providing sufficient air flow to the center of the unit making the unit inefficient. Also, the relatively flat condensate pans do not drain well leaving stagnant puddles of water which can promote dangerous bacterial growth.

SUMMARY OF THE INVENTION

It is the purpose of the present invention to provide an improved gravity cooling unit which is much more efficient than the known units. It is another purpose of the present invention to provide an improved gravity cooling unit which requires less vertical space when mounted from the ceiling. It is another purpose of the present invention to provide a gravity cooling unit which handles the condensate associated with the unit more efficiently thereby minimizing the risk of bacterial growth problems.

In accordance with the present invention it has been discovered that if the column of a cooling unit is angled to the vertical, the column can be mounted almost directly against the ceiling thus reducing the vertical space required for the unit. The warm air in the room will flow up the wide side of the fin structure facing the ceiling and will fall through the fins, being cooled, to emerge from the wide side of the fin structure facing away from the ceiling. The angled position of the column enhances the flow of the air through the fins making the unit more efficient. Also, with the columns being angled, the lengths of the cooling tubes in the column are staggered horizontally and condensate does not drip from one to another thereby further increasing efficiency. Condensate collection is improved by providing a condensate collector, in the form of a condensate pan, under the column that has its bottom wall parallel to the bottom of the fins. Condensate thus flows down the bottom wall to its juncture with the an inner side wall to collect in the junction and flow toward one end of the pan. The sloping bottom wall eliminates the likelihood of stagnant areas or puddles of condensate collecting on the bottom wall. Condensate is also collected more efficiently off the fins when using an angled column. The condensate runs down the surfaces of the fin to its lower side edges, and then down the edges to drop off the lowest corner of the fins into the wall junction in the condensate pan.

A plurality of the angled columns can be mounted in parallel to form a single cooling unit. A vertical partition can separate adjacent columns. It is preferred however that the columns be arranged in pairs with the two columns in each pair angled toward each other toward the top. Each pair of columns, when viewed from the end, will form an A-frame shaped structure. The downwardly diverging space between the two columns, through which the cooled air drops, will act as a draft inducer improving the flow of air through the unit and making it still more efficient.

A baffle can be provided along the lower part of the wide side of the fin structure that faces the ceiling. The baffle prevents the rising warm air from immediately entering the fins. The warm air must rise over the baffle before entering the fins and this again induces more air flow through the fins because some of the cool air now exits substantially lower from where the warm air enters. Greater air flow improves efficiency.

Preferably a second condensate pan is provided beneath the first condensate pan on each column. The second pan carries away any condensate that may overflow the first condensate pan, collects any condensate that may form on the bottom of the first pan, and more importantly, insulates the first condensate pan from the warm air below the pans to minimize freezing. The second condensate pan is unshaped with its bottom wall generally horizontal and spaced a slight distance from the bottom wall of the first condensate pan. Preferably the outer side wall of the second condensate pan is made longer than the inner side wall of the pan. This longer, outer wall forms the baffle along the lower, outer part of the fins.

The condensate collector can also be in the form of condensate pan having a bottom wall that is hollow. The hollow structure insulates the top surface of upper wall section of the bottom wall and also serves to collect any condensation that may form on the bottom of the upper wall section of the bottom wall.

The invention is particularly directed toward a gravity cooling unit having at least one pair of cooling columns, each cooling column consisting of a plurality of spaced-apart, rectangular, parallel, cooling fins mounted on lengths of cooling pipe which lengths are joined at their ends outside the fins to form one or more serpentine cooling coils in the column. The cooling unit has mounting means for use in mounting the unit on a ceiling. The cooling columns are each fixed to the mounting means to have the longitudinal axis of the fins at a small acute angle to the vertical and a short side of the fins substantially against the ceiling when the cooling unit is mounted on the ceiling. The pair of cooling columns diverge from each other downwardly from the ceiling to form a vertical, downwardly diverging, air path between them. A condensate collector is positioned under each column, the collector extending the length of the column and at least wide enough to be located under all the pipe lengths in each column

DESCRIPTION OF THE PREFERRED EMBODIMENTS

Figure 1:
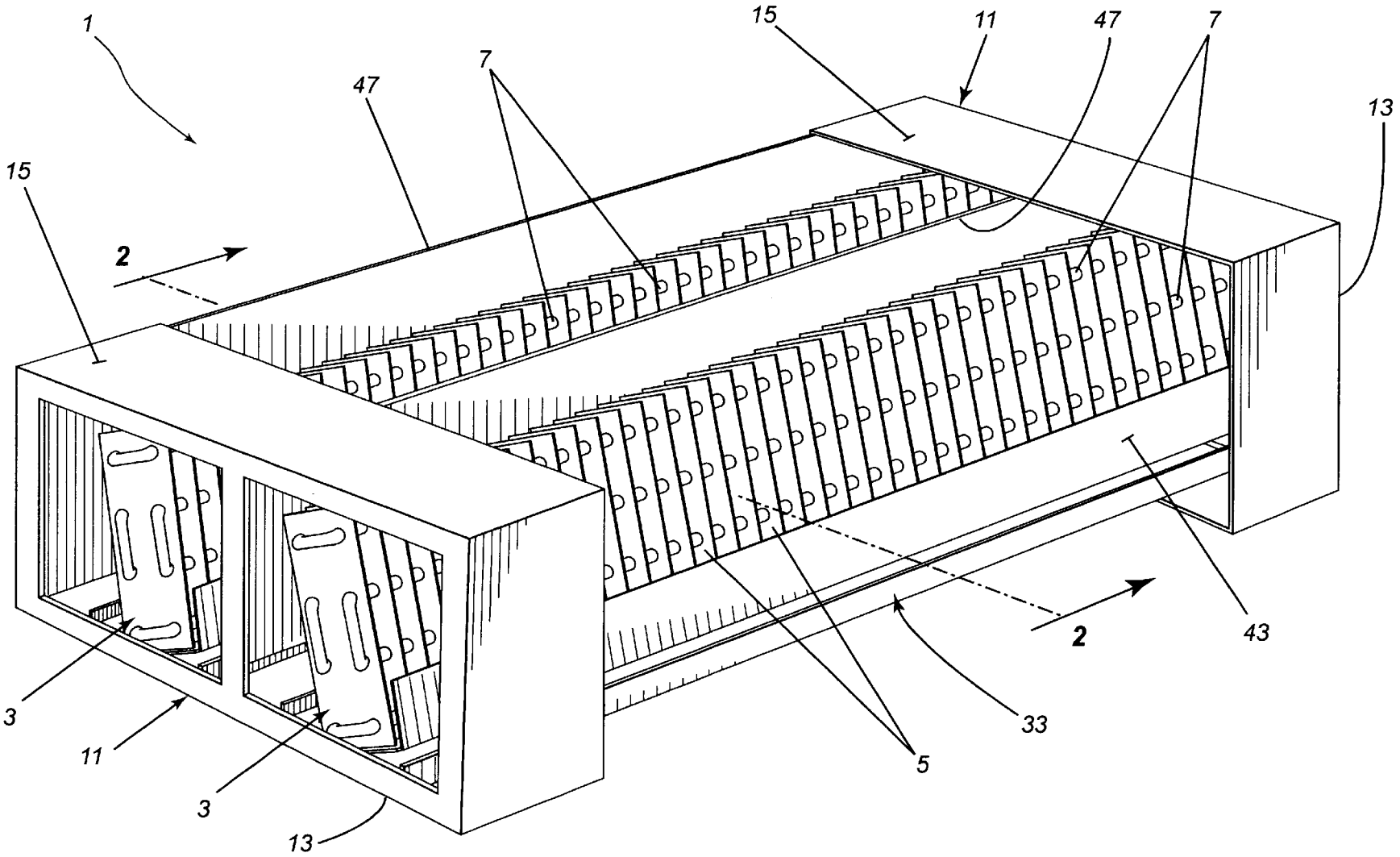
FIG. 1 is a perspective view of a cooling unit of the present invention.
Figure 2:
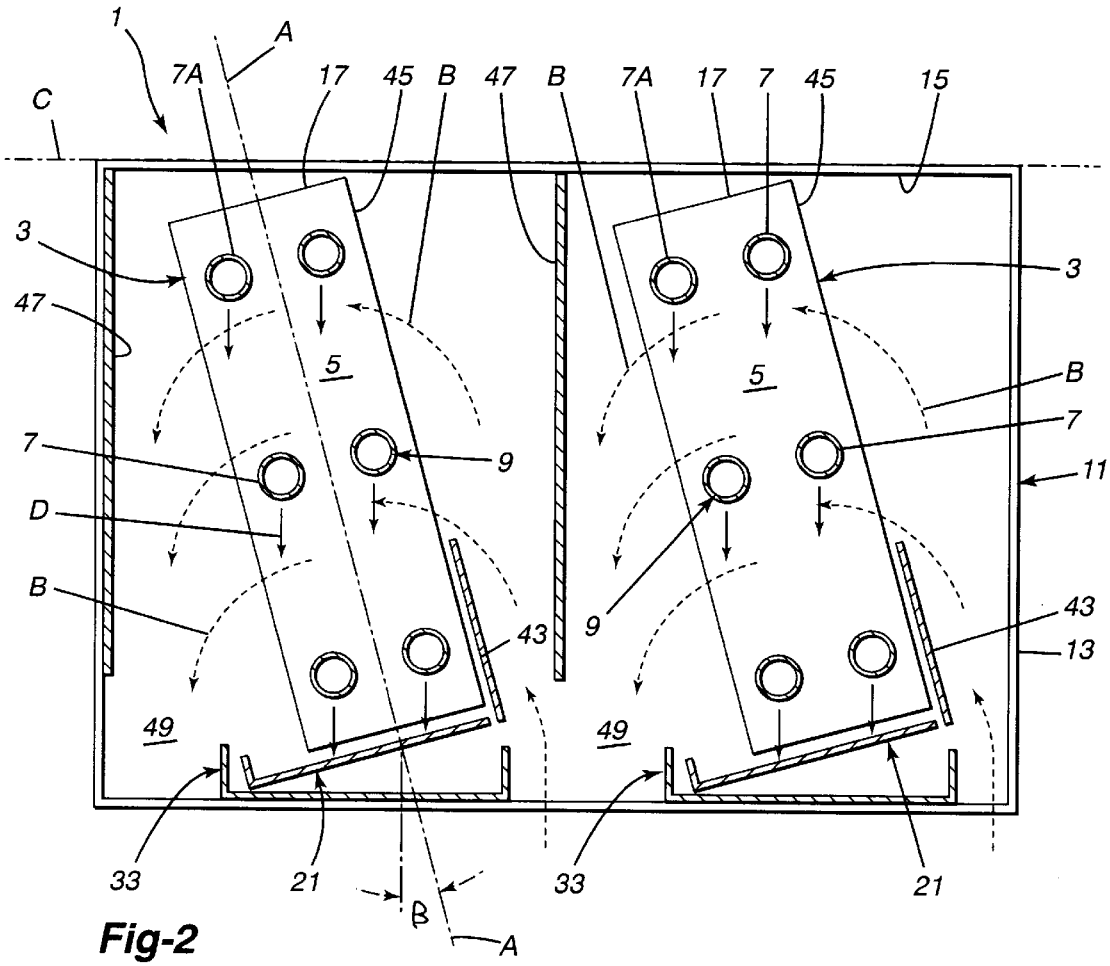
FIG. 2 is a cross-section view along line 2—2 in FIG. 1.
Figure 3:
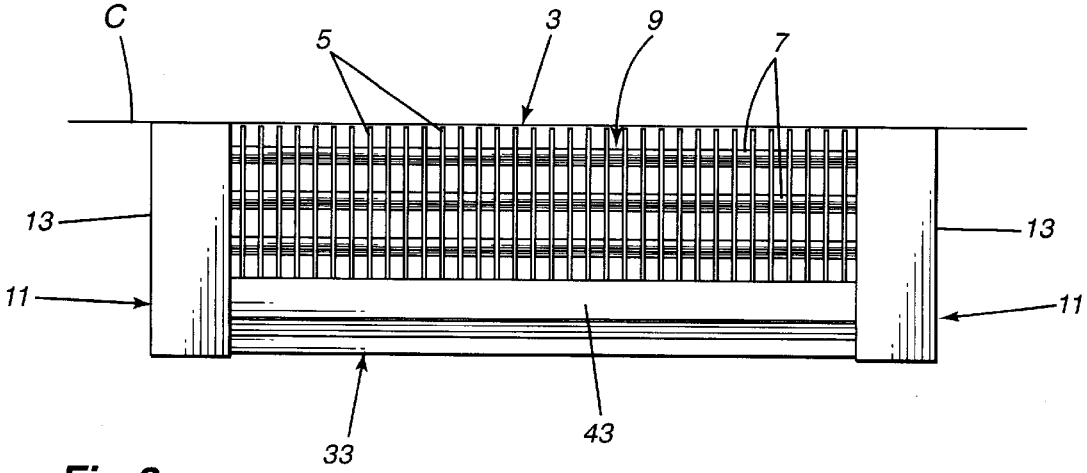
FIG. 3 is an elevation view of the cooling unit, partly in section.

The cooling unit 1, in one embodiment as shown in FIGS. 1 to 3, has one or more cooling columns 3. Each cooling column 3 consists of a plurality of spaced-apart, elongate, cooling fins 5 mounted parallel to each other on lengths of pipe 7 which extend transverse to the fins 5. The cooling fins 5 are preferably rectangular in shape. The lengths of pipe 7 are joined at their ends outside the fins 5 to form at least one serpentine cooling coil 9 which carries a refrigerant or a cooling fluid. The fins 5 form a slab-like structure.

The cooling columns 3 (two shown) are fixed to mounting means 11 which mounting means are used to mount the cooling unit to a ceiling "C". The ceiling "C" is usually the ceiling of a room but can also be the "ceiling" of a casing or cabinet that is mounted on a vertical wall in the room. The "ceiling" could also be the top of any cooling or refrigerating casing or cabinet. The mounting means can comprise a pair of mounting brackets 13, one at each end of the columns 3. The brackets are identical. Each has a top plate 15, by means of which, the unit is mounted to the ceiling. Each cooling column 3 is mounted on the brackets 13 so that the long axis "A" of the fins 5 is at a slight acute angle "β" to the vertical when the unit is mounted on a ceiling as shown in FIG. 2. This angle "β" can range between nine degrees and fifteen degrees. Preferably it is around thirteen degrees. Each cooling column 3 is also mounted on the brackets 13 to have the narrow top sides 17 of the fins 5 closely adjacent to the ceiling.

Figure 4:
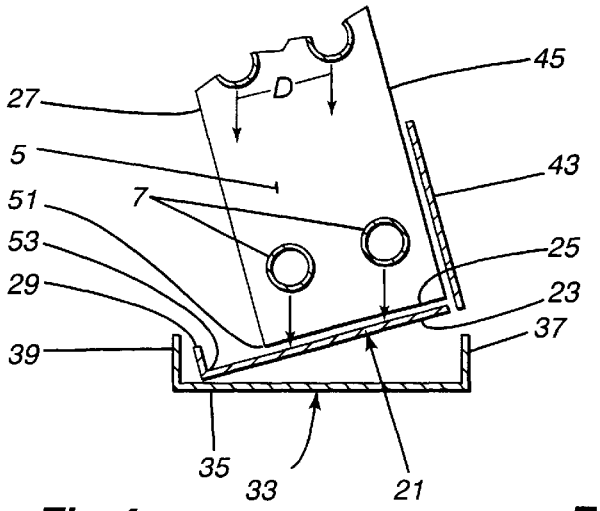
FIG. 4 is a detail cross-section of the bottom of a column.

A condensate collector 19, in the form of a first, inner, condensate pan 21, is provided under each cooling column 3. Each condensate pan 21 has an L-shaped cross-section with a wide bottom wall 23 that is parallel to the narrow, bottom sides 25 of the fins 5 as shown in FIG. 4. The bottom wall 23 is slightly wider than the fins 5 and extends past the inner long sides 27 of the fins 5. A short side wall 29 extends up from the inner edge of the bottom wall 23, parallel to the long sides 27 of the fins 5 and slightly spaced therefrom. The ends of the condensate pan 21 are attached to the brackets 13 to have the bottom wall 23 slightly spaced from the fins 5.

The condensate collector 19 Preferably includes a second, outer, condensate pan 33 provided under the first pan 21. The second condensate pan 33 has a shallow, unshaped cross-section with a bottom wall 35, and two short side walls 37, 39 as shown in FIG. 4. The bottom wall 33 is horizontal, parallel to the top plate 15 of the bracket 13 when viewed from an end, and is spaced slightly from the bottom wall 23 of the first, inner condensate pan 21. The first pan 21 sits within the second pan 33. The second pan 33 collects any condensate overflow from the first pan 21, collects any condensate that may form on the bottom of the first pan, and also serves to insulate the first pan to minimize freezing on the first pan.

Figure 5:
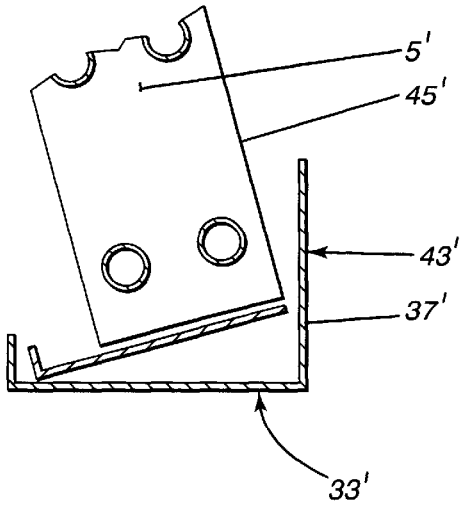
FIG. 5 is a view similar to FIG. 4 showing another embodiment of the invention.

A baffle 43 can be provided across the lower part of the outer, long sides 45 of the fins of each column. The baffle 43 can extend between the brackets 13 and is attached at its ends to the brackets. The baffle 43 prevents warm air from entering the fins 5 in their lower portion. The baffle 43 creates a greater separation between the entrance of the air into the fins and its exit thereby increasing efficiency. Preferably, as shown in FIG. 5, the baffle 43' is formed by extending the outer side 37' of the second, outer, condensate pan 33'. This outer side 37' can extend between one fifth and one quarter the way up the long side 45' of the fins 5'.

A partition 47, mounted on the brackets 13, extends vertically down near the inner, long side 27 of the fins 5 in each column 3 as shown in FIG. 2. A downwardly diverging air space 49 is formed between the partition 47 and the column 3.

In use, a refrigerant or cooling fluid is passed through the serpentine coil 9 to cool the fins 5. As the fins 5 cool, they cool the warm air between the fins which cooled air, being denser, drops from the fins, along their long inner sides 27, into the diverging air space 49. As the cooled air leaves the fins 5 and the air space 49, more warm air is induced to flow up the outer, long sides 45 of the fins 5, which outer long sides face the ceiling past the baffle 43 and into the fins as shown by the arrows "B" in FIG. 2 to replace the cooled air and to be cooled in turn. Any condensate that forms on the surfaces of the fins 5 runs straight down. A portion of this condensate will reach the inner long side 27 of the fins 5 and then run along this side 27 until it reaches the lower corner 51 of the fin 5, dropping off into the junction 53 or through formed between the bottom 23 and side 29 walls of the inner, condensate pan 21. Collecting the condensate along the edge or side 27 is more efficient since surface tension is substantially eliminated. Both condensate pans 21, 33 slope slightly toward one end of the unit and the condensate is collected from both pans 21, 33 at the one end by suitable means (not shown). It will be seen that the condensate pans 21, 33 do not close off the diverging opening 49. The pans 21, 33 project past the bottom corner 51 of the fins 5 just enough to be beneath the most innermost length of pipe 7A. Thus all the condensate dripping off the pipe lengths 7 between the fins 5, as shown by the arrows "D", will be caught by the pans 21, 33. Since the columns 3 are angled the pipe lengths 7 are staggered horizontally and most of the condensate that drops down off the pipe lengths will drop into the pans without contacting other pipe lengths as would be the case if the column was vertical. Having the dripping pipe condensate avoid other pipes improves the efficiency off the unit.

Figure 6:
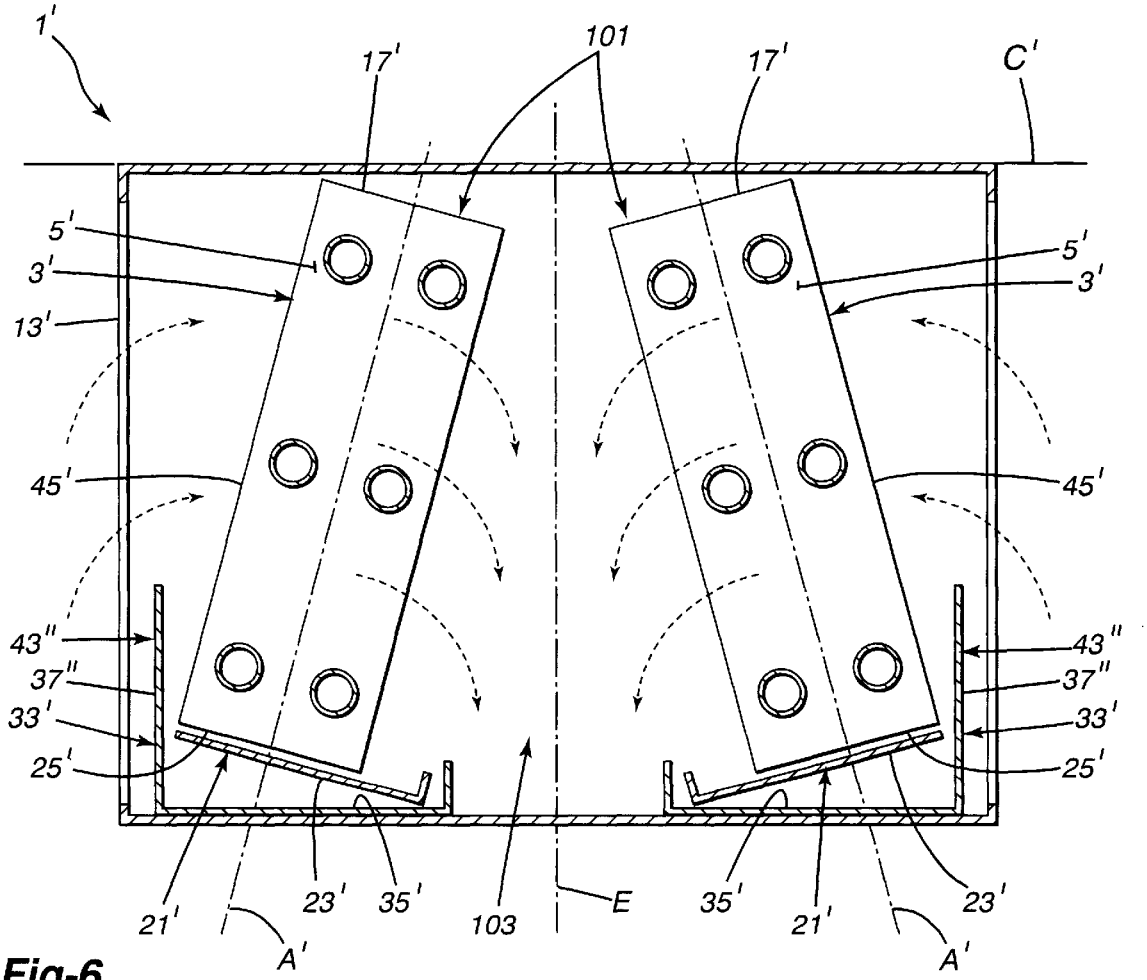
FIG. 6 is a cross-sectional view of another embodiment of the cooling unit.

In a preferred embodiment of the cooling unit, as shown in FIG. 6, the columns 3' are arranged in one or more pairs 101 in the cooling unit 1'. Each pair 101 of columns 3' have the long axis "A" of the fins 5' of each column angled slightly toward the vertical center "E" of the pair with the top sides 17' of the fins 5' closer together than the bottom sides 25'. A diverging air space 103 is formed between the pair of columns. The columns are supported in end brackets 13' as before with the brackets holding tops of the columns closely adjacent to the ceiling "C'" when the unit is mounted on the ceiling. Each pair 101 of columns, when viewed from the end, form an A-frame type of structure. A condensate collector 19' in the form of a first condensate pan 21' is provided under each column as before. The bottom 23' of the first pan is parallel to the bottom side 25' of the fins 5' of the column and projects slightly past it to form a junction with a low side wall 29'. A second condensate pan 33' is located beneath the first pan. The second pan is unshaped and holds the first pan 21' within it with its bottom wall 35' generally horizontal and spaced from the bottom wall 23' of the first pan to insulate it. The bottom wall 35' slopes slightly toward one end of the unit. The outer side 37" of the outer pan is extended to form a baffle 43" extending part way up the outer side 45' of the fins to improve air flow. Alternatively, a separate baffle plate could be provided.

In use, warm air flows up the outer sides of both columns in each pair 101 and passes through and down the fins to emerge in the diverging air space 103 as cooled air. As the cooled air drops, more warm air is drawn in to replace it. The downwardly diverging air space 103 increases the efficiency of the unit, since it is able to handle progressively increasing amounts of cooled air entering the space. This improves flow. No clearance is required at the top of the unit for air flow thereby making the unit more compact. The increased efficiency of the unit provides for greater cooling per cubic inch of space occupied by the unit as compared to prior art units. The increased efficiency can also be used to build units with smaller pipe lengths thereby decreasing costs.

Figure 7:
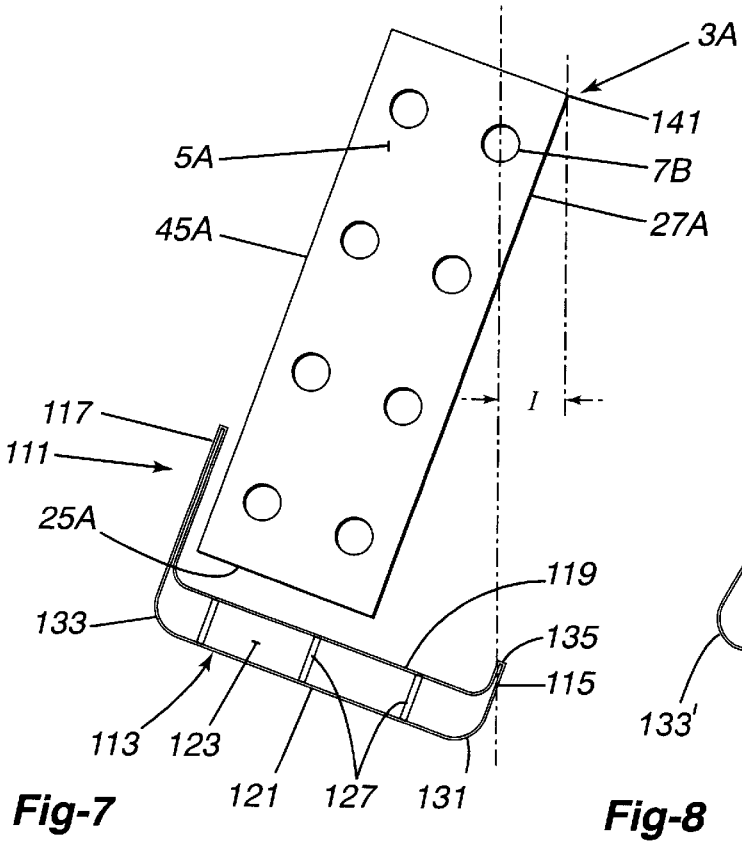
FIG. 7 is a cross-sectional view of another embodiment of the cooling unit with a different condensate collector.

The condensate pans 21, 33 and 21', 33' have been shown as separate units. They can however be combined into one condensate pan. As shown in FIG. 7, a condensate pan 111 is provided having a bottom wall 113, a relatively short, inner, side wall 115, and a relatively long, outer, side wall 117. The bottom wall 113 is hollow, having an inner bottom wall section 119 and an outer bottom wall section 121 spaced a short distance from the inner bottom wall section 119. The inner and outer bottom wall sections 119, 121 are joined together at their sides forming a closed space 123 between them. The space 123 between the inner and outer bottom wall sections 119, 121 serves to insulate the inner bottom wall section 119 to minimize the formation of condensate on its bottom surface and also to prevent freezing of condensate in the pan 111. Air flows through the space 123 from the ends of the pan. Spacers 127 can be provided between the inner and outer bottom wall sections 119, 121 to maintain them in spaced relation.

The outer corners 131, 133 of the bottom wall 113 are preferably rounded, as shown, by curving the outer sides of the outer bottom wall section 121 upwardly to join the inner bottom wall section 119. The rounded corners 131, 133 increase the efficiency of the air flow through the unit.

A condensate pan 111 is mounted under the fins 5A of each column 3A with its bottom wall 113 generally parallel to the short side 25A of the fins 5A and spaced therefrom, and with its short, inner side wall 115 extending up parallel to the inner long side 27A of the fins for a short distance. The relatively long, outer side wall 117 of the condensate pan extends part way up the outer long side 45A of the fins to form a baffle preventing air flow into the fins at the lower part of the fins.

The bottom wall 113 is made wide enough so that when mounted under the fins, its inner extremity 135 (the free edge of inner side wall 115) is located just under the innermost pipe length 7B of the unit. This ensures that the pan will catch any drips from the bottoms of all the coils in the unit.

This condensate pan 111 differs from the previous pans in that there is no separate outer pan to catch any overflow from an inner pan. However, this condensate pan 101, with the hollow bottom wall 103, minimizes the formation of condensate on the bottom of the upper bottom wall section 119 and also insulates it to prevent freezing of condensate in the pan.

Condensate pan 111 is preferably formed by extrusion from suitable plastic material and cut into the lengths required to extend under the entire length of the fin and coil unit.

Figure 8:
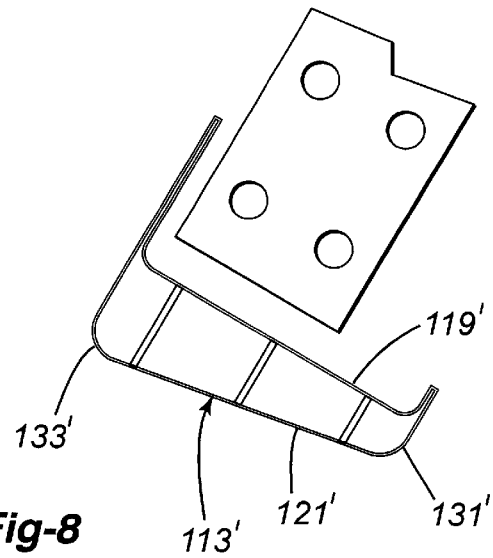
FIG. 8 is a variation of the unit shown in FIG. 7.

In a modification of the pan 111, the bottom wall 113' can be formed to have the bottom outer wall section 121' diverge away from the bottom inner wall section 119' in going from the inner corner 131' to the outer corner 133' as shown in FIG. 8. This deepens the bottom wall 113' and makes it more rigid in order to span longer fin and coil units without bending or bowing in the middle.

In the fin and coil units shown, the pipe lengths 7 are shown as being in upright rows, the top lengths in each row parallel with the top edge of the fins; the second-from-the top lengths in each row parallel with the top edge of the fins; the third-from-the top lengths in each row parallel with the top edge of the fins; etc. This locates a pipe length 7B very near to the upper, inner corner 141 of each fin as shown in FIG. 7.

Figure 9:
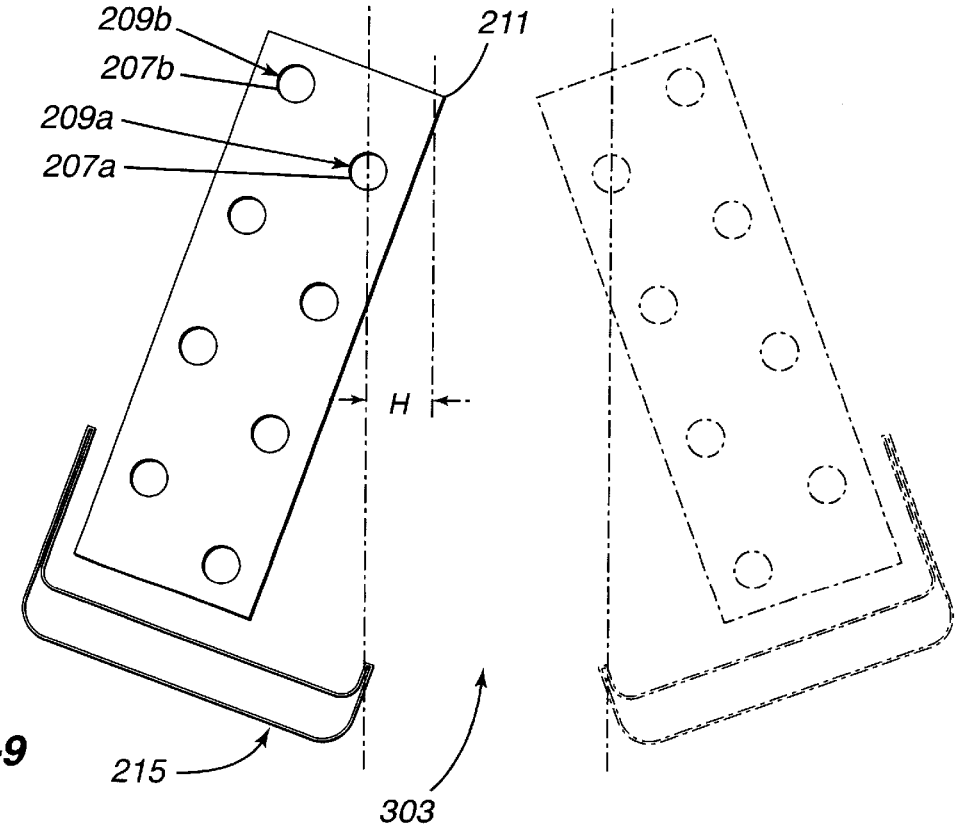
FIG. 9 is a cross-sectional view of a variation in the coil arrangement in the cooling unit.

Preferably, the fin and coil units are constructed to have the pipe lengths staggered with the upper, inner length 207*a* in the inner pipe length row 209*a* below the upper, outer length 207*b* in the outer pipe length row 209*b* as shown in FIG. 9. The remaining pipe length pairs in the two rows are similarly staggered. This arrangement locates the upper, inner pipe length 207*a* farther away, in a horizontal direction from upper inner corner 211 of each fin. In this new arrangement, the pipe length 207*a,* is located a distance "H" from the corner 211 while in the old arrangement, shown in FIG. 7, the pipe length 7B, is located a distance "I" from the upper corner. Distance "H" is greater than distance "I". Thus, the condensate pan 215 does not have to be as wide to be located under the uppermost inner length 207*a* in the new arrangement and this widens the gap 303 between the condensate pans in the angled pairs of columns through which the cooled air returns from the unit. A wider gap makes air flow through the unit more efficient.

We claim:

1. A gravity cooling unit having:

at least one pair of cooling columns, each column having a plurality of spaced-apart, rectangular, parallel cooling fins mounted on lengths of pipe which extend transversely to the fins, the pipe lengths joined at their ends past the fins to form one or more serpentine coils which can carry one of a refrigerant and a cooling fluid;

mounting means for use in mounting the cooling unit against a ceiling; each column fixed to the mounting means to have:

the top, short, side of the fins closely adjacent the ceiling to substantially prevent the passage of air between the top of the column and the ceiling;

the long axis of the fins angled, from the vertical, toward the long axis of the fins in the other column of the pair to form a downwardly diverging air space between the columns;

the long axis of the fins at an angle to the vertical sufficient, when the unit is mounted to the ceiling, to have warm air ride up the outer, long, sides of the elongate fins, which sides face the ceiling, to drop down through the fins to be cooled and into the diverging air space; and a condensate collector under the fins of each column extending the length of the column; the collector having a width at least wide enough to be located under all the coils in the column.

2. A cooling unit as claimed in claim 1 wherein each condensate collector includes a baffle extending part way up the outer, long, sides of the fins of its associated column to block the entry of warm air into the lower part of the fins, the baffle adjacent the fins to prevent the flow of air between the baffle and the fins.

3. A cooling unit as claimed in claim 1 including a baffle covering the lower part of the outer, long side of the fins in each column to block the entry of warm air into the lower part of the fins, the baffle adjacent the fins to prevent the flow of air between the baffle and the fins.

4. A cooling unit as claimed in claim 1 wherein the long axis in each column is angled at an angle from the vertical which ranges between nine degrees and fifteen degrees.

5. A cooling unit as claimed in claim 1 wherein the condensate collector has a first condensate pan under the column, the pan having a bottom wall parallel with the bottom, short side of the fins, and a inner, side wall extending up from the lower edge of the bottom wall, the bottom wall and side wall forming a trough to receive condensate.

6. A cooling unit as claimed in claim 5 including a second, u-shaped, condensate pan beneath the first pan, the first pan located within the second pan, the second pan having a bottom wall spaced from the bottom wall of the first pan.

7. A cooling unit as claimed in claim 6 wherein the bottom wall of the second pan is parallel to the ceiling when viewed from one end of the unit when the unit is mounted on the ceiling, the bottom wall of the second pan sloping slightly toward one end of the unit.

8. A cooling unit as claimed in 6 wherein the outer side of the second condensate pan, adjacent the outer, long side of the fins that face the ceiling, is extended to provide a baffle that covers the lower part of the outer, long side of the fins to block the entry of warm air into the lower part of the fins.

9. A cooling unit as claimed in claim 1 wherein the condensate collector has a bottom wall parallel with the bottom, short side of the fins, and an inner, side wall extending up from the lower edge of the bottom wall, the bottom wall being hollow with an outer bottom wall section spaced a short distance from an inner bottom wall section.

10. A cooling unit as claimed in claim 9 wherein the outer bottom wall section diverges from the inner bottom wall section in a direction away from the inner, side wall.

11. A cooling unit as claimed in claim 9 wherein the collector has an outer, side wall extending up from the upper edge of the bottom wall on the outer, long side of the fins to form a baffle to block the entry of warm air into the lower part of the fins.

12. A cooling unit as claimed in claim 10 wherein the collector has an outer, side wall extending up from the upper edge of the bottom wall on the outer, long side of the fins to form a baffle to block the entry of warm air into the lower part of the fins.

13. A cooling unit as claimed in claim 11 wherein the outer corners of the collector, where the inner and outer side walls join the bottom wall, are rounded.

14. A cooling unit as claimed in claim 12 wherein the outer corners of the collector, where the inner and outer side walls join the bottom wall, are rounded.

15. A cooling unit as claimed in claim 9 wherein spacers are provided between the inner and outer bottom wall sections.

16. A cooling unit as claimed in claim 10 wherein spacers are provided between the inner and outer bottom wall sections.

17. A cooling unit as claimed in claim 1 wherein the pipe lengths in each column are arranged in at least two rows in each fin with the pipes in the inner row, adjacent the inner, long side of the fins, staggered below the pipes in the outer row so as to have the uppermost pipe in the inner row located farther away, in a horizontal direction, from the upper, inner corner of the fin than if the pipes in the inner row were not staggered.

18. A cooling unit as claimed in claim 2 wherein the pipe lengths in each column are arranged in at least two rows in each fin with the pipes in the inner row, adjacent the inner, long side of the fins, staggered below the pipes in the outer row so as to have the uppermost pipe in the inner row located farther away, in a horizontal direction, from the upper, inner corner of the fin than if the pipes in the inner row were not staggered.

19. A cooling unit as claimed in claim 3 wherein the pipe lengths in each column are arranged in at least two rows in each fin with the pipes in the inner row, adjacent the inner, long side of the fins, staggered below the pipes in the outer row so as to have the uppermost pipe in the inner row located farther away, in a horizontal direction, from the upper inner corner of the fin than if the pipes in the inner row were not staggered.

* * * * *